US009545705B2

(12) United States Patent
Hu et al.

(10) Patent No.: US 9,545,705 B2
(45) Date of Patent: Jan. 17, 2017

(54) REVERSIBLE RATCHET WRENCH

(71) Applicant: Bobby Hu, Taichung (TW)

(72) Inventors: Bobby Hu, Taichung (TW); Chi-Jui Lo, Taichung (TW)

(73) Assignee: Bobby Hu, Taichung (TW)

( * ) Notice: Subject to any disclaimer, the term of this patent is extended or adjusted under 35 U.S.C. 154(b) by 315 days.

(21) Appl. No.: 14/493,395

(22) Filed: Sep. 23, 2014

(65) Prior Publication Data

US 2016/0008959 A1 Jan. 14, 2016

(30) Foreign Application Priority Data

Jul. 10, 2014 (TW) ..... 103123784 A

(51) Int. Cl.
*B25B 13/46* (2006.01)

(52) U.S. Cl.
CPC ..... *B25B 13/463* (2013.01)

(58) Field of Classification Search
CPC ..... B25B 13/463
See application file for complete search history.

(56) References Cited

U.S. PATENT DOCUMENTS 6,629,477 B2 10/2003 Ling et al.
7,938,043 B2 * 5/2011 Hu ..... B25B 13/463 81/63
2014/0060259 A1 * 3/2014 Hu ..... B25B 13/46 81/63.2

* cited by examiner

*Primary Examiner* — David B Thomas
(74) *Attorney, Agent, or Firm* — Alan D. Kamrath; Kamrath IP Lawfirm, P.A.

(57) ABSTRACT

A reversible ratchet wrench includes a body rotatably receiving a driving member, slideably receiving a pawl, and pivotably receiving a switch button. A pressing member and an elastic element are received in a pressing member receptacle in the switch button. An end of the pressing member outside of the pressing member receptacle has a first spacing to a first side of the switch button. A protrusion is provided on the first side of the switch button and has a second spacing to the first side of the switch button. If the pawl slides in the compartment while the body rotates in a non-driving direction and if the pawl does not disengage from the driving member, the protrusion presses against the pawl to disengage the pawl from the driving member when the elastic element is compressed to an extent in which the first spacing is not larger than the second spacing.

11 Claims, 12 Drawing Sheets

REVERSIBLE RATCHET WRENCH

BACKGROUND OF THE INVENTION

The present invention relates to a ratchet wrench and, more particularly, to a reversible ratchet wrench.

U.S. Pat. No. 6,629,477 discloses a reversible ratchet wrench including a handle and a driving member rotatably mounted in the handle. The driving member can couple with a socket for engaging with a fastener, such as a screw or nut. The fastener can be rotated when a user rotates the handle. A retaining member is slideably received in a retaining recess in the handle and selectively engages with the driving member. A direction control member is rotatably mounted in a receiving chamber of the handle. A pressing member and an elastic member are mounted in a first receiving recess in the direction control member. The pressing member is biased by the elastic member to press against the retaining member. When the direction control member is rotated, the position of the retaining member pressed by the pressing member can be changed to change the driving direction of the driving member.

In assembly, the direction control member is firstly placed into the receiving chamber, and the pressing member and the elastic element are passed through the receiving chamber into the first receiving recess. Finally, the retaining member and the driving member are mounted to the handle in sequence. The pressing member is retained in the handle to prevent the direction control member from disengaging from the receiving chamber. Grease is filled between the retaining member and the driving member to permit smooth engagement and smooth disengagement therebetween. The reversible ratchet wrench cannot be completely sealed during assembly such that oil from the outside and scraps generated by friction between the driving member and the retaining member accumulate between the driving member and the retaining member, adversely affecting the engagement and disengagement therebetween. In a case that the retaining member cannot disengage from the driving member due to improper operation by a user, the pressing member will deform and damage due to excessive pressing by the retaining member if the user keeps applying a rotational force in a reverse direction. Thus, the reversible ratchet wrench malfunctions and cannot be used. Furthermore, when the pressing member is pressed into the first receiving recess due to excessive pressing, the pressing member loses its limiting function, leading to disengagement of the direction control member from the receiving chamber. If the user is working with his or her head raised for tightening a fastener above his or her head, the direction control member falling from the receiving chamber could hit the head and endangers the user.

Furthermore, water or sweat could enter the reversible ratchet wrench after a period of time of use, leading to rusting of the driving member and the retaining member and, thus, adversely affecting smooth engagement and/or disengagement therebetween, which also causes damage to the reversible ratchet wrench.

Thus, a need exists for a novel reversible ratchet wrench that mitigates and/or obviates the above disadvantages.

BRIEF SUMMARY OF THE INVENTION

This need and other problems in the field of durable reversible wrenches are solved by a reversible ratchet wrench including a body having an operative portion and a driving end connected to the operative portion. The operative portion is adapted to be gripped by a user. The driving end includes a receiving space and a compartment intercommunicated with the receiving space. The body further includes a hole intercommunicating the compartment with an outside. A driving member is mounted in the receiving space and is rotatable about a rotational axis relative to the driving end of the body. The driving member includes a driving portion adapted for directly or indirectly driving a fastener. The driving member further includes an annular toothed portion on an outer periphery thereof. A pawl is slideably received in the compartment. The pawl includes a first side having a toothed portion disengageably engaged with the annular toothed portion of the driving member. The pawl further includes a second side. A switch button is received in the hole of the body and is pivotable relative to the body about a pivotal axis parallel to the rotational axis. The switch button includes a first side facing the compartment and a second side opposite to the first side. The switch button further includes a pressing member receptacle extending from the first side towards the second side. An elastic element is received in the pressing member receptacle. A pressing member is received in the pressing member receptacle and has a first end located outside of the pressing member receptacle. The first end of the pressing member has a first spacing to the first side of the switch button. The first end of the pressing member is biased by the elastic element to press against the second side of the pawl, causing engagement between the toothed portion of the pawl and the annular toothed portion of the driving member. A protrusion is provided on the first side of the switch button and includes a contact portion having a second spacing to the first side of the switch button.

The switch button is operable to pivot relative to the body to change a driving direction and a non-driving direction of the body. The driving member and the fastener coupled to the driving member are adapted to rotate jointly with the body while the body rotates in the driving direction. The driving member and the fastener coupled to the driving member are adapted to remain still when the body rotates in the non-driving direction.

The pawl slides in the compartment and is pressed by the pressing member to disengage from the annular toothed portion of the driving member while the body rotates in the non-driving direction, and the first spacing of the pressing member is not smaller than the second spacing of the protrusion.

If the pawl slides in the compartment while the body rotates in the non-driving direction and if the pawl pressed by the pressing member does not disengage from the annular toothed portion of the driving member, the contact portion of the protrusion presses against the pawl to disengage the pawl from the annular toothed portion of the driving member when the elastic element is compressed to an extent in which the first spacing of the pressing member is not larger than the second spacing.

In examples, the switch button further includes a fixing member receptacle extending from the first side towards the second side of the switch button. A fixing member is received in the fixing member receptacle and has a first end exposed outside of the fixing member receptacle. The first end of the fixing member forms the protrusion.

In an example, the fixing member receptacle extends from the first side towards but spaced from the second side of the switch button, and the fixing member further includes a second end abutting an end wall of the fixing member receptacle.

In another example, the fixing member receptacle extends from the first side through the second side of the switch button, and the fixing member further includes a second end pivotably abutting an abutment wall of the hole of the body. The second side of the switch button pivotably abuts the abutment wall.

The fixing member can be solid and have circular or rectangular cross sections.

Preferably, the fixing member has a hardness larger than a hardness of the pawl. Preferably, the switch button has a hardness larger than a hardness of the pawl.

In examples, the pressing member receptacle and the fixing member receptacle extend perpendicularly to the pivotal axis, are parallel to each other, and are spaced from each other along the pivotal axis.

In examples, the pressing member receptacle extends from the first side towards but spaced from the second side of the switch button. The elastic element further has a second end abutting an end wall of the pressing member receptacle. The second side of the pawl includes a recessed portion. The first end of the pressing member presses against the recessed portion.

In examples, the body includes two limiting portions between the compartment and the hole. The two limiting portions are spaced from each other in a width direction perpendicular to the pivotal axis. Pivotal movement of the switch button about the pivotal axis is stopped when the pressing member contacts and is stopped by one of the two limiting portions.

Illustrative embodiments will become clearer in light of the following detailed description described in connection with the drawings.

DESCRIPTION OF THE DRAWINGS

The illustrative embodiments may best be described by reference to the accompanying drawings where.

Figure 1:
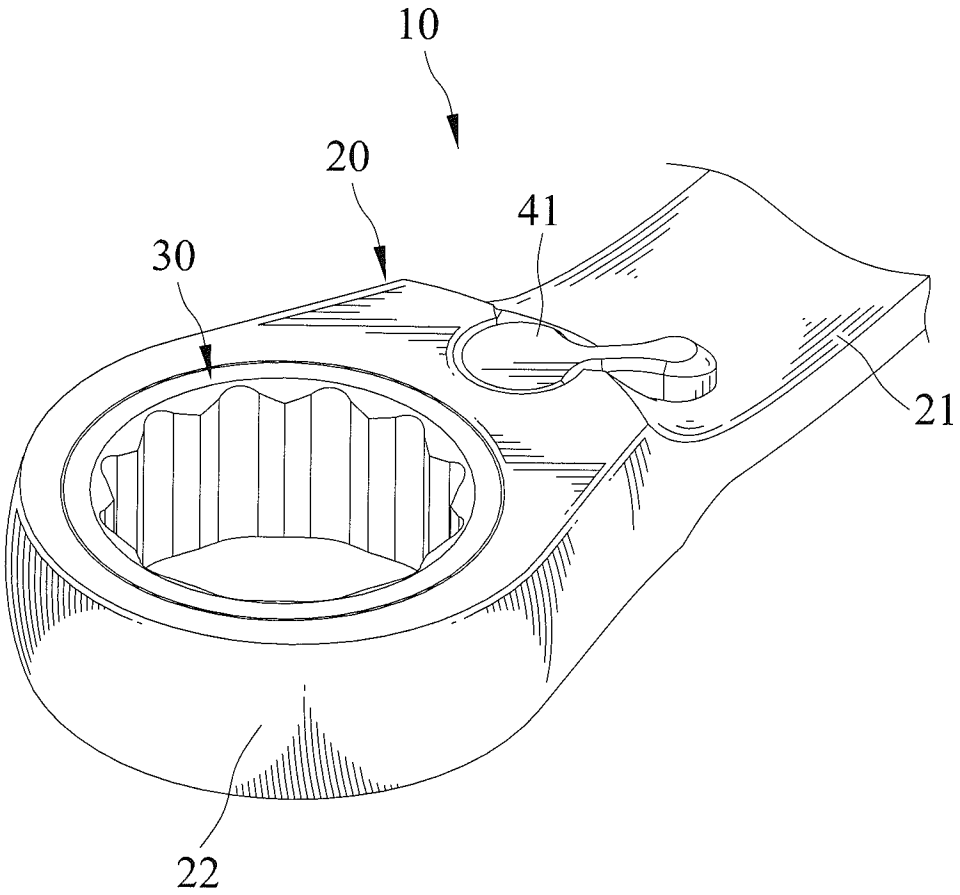
FIG. 1 is a partial, perspective view of a reversible ratchet wrench of a first embodiment according to the present invention.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "bottom", "side", "end", "portion", "spacing", "length", "width", "thickness", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE INVENTION

Figure 2:
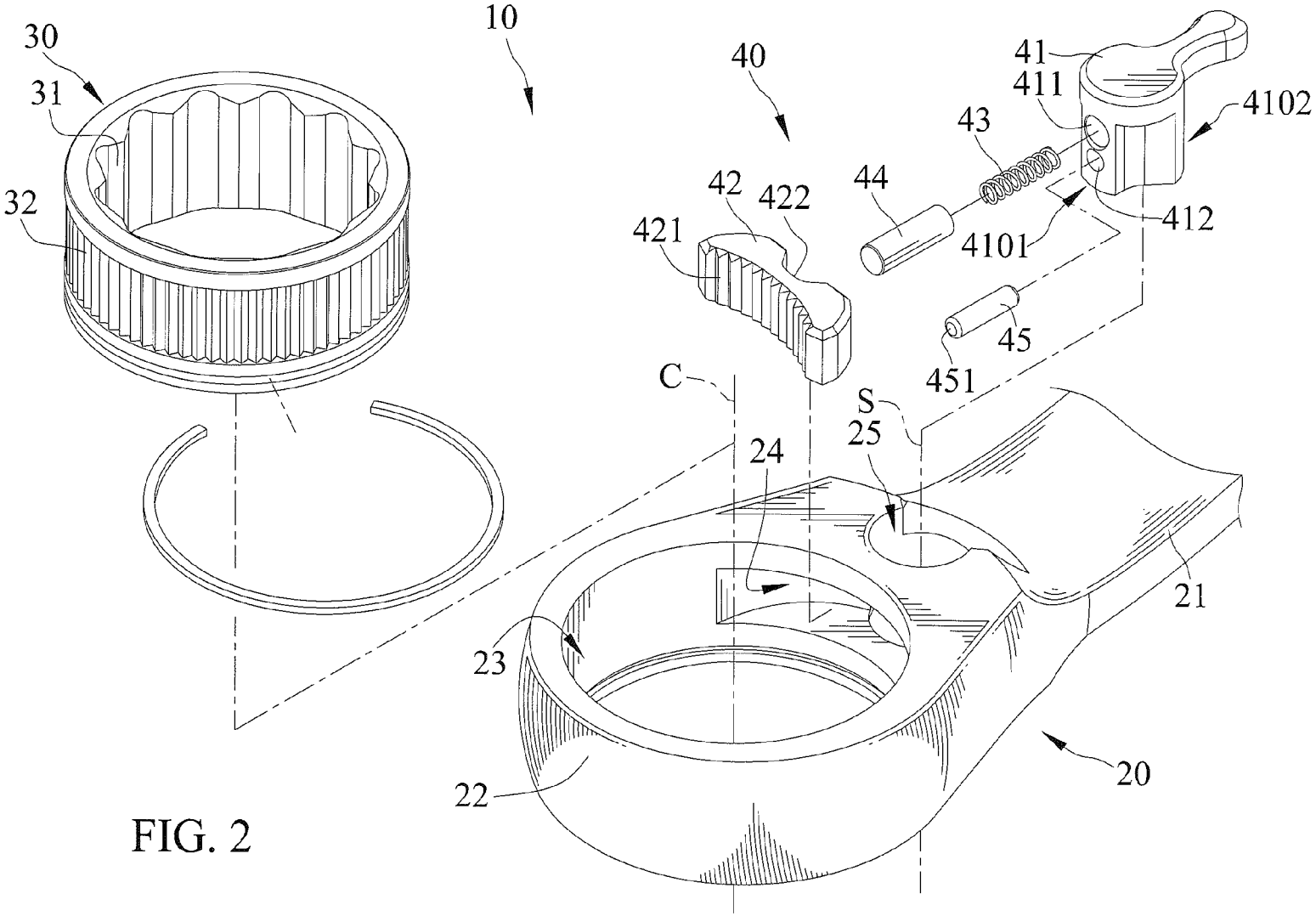
FIG. 2 is a partial, exploded, perspective view of the reversible ratchet wrench of FIG. 1.
Figure 3:
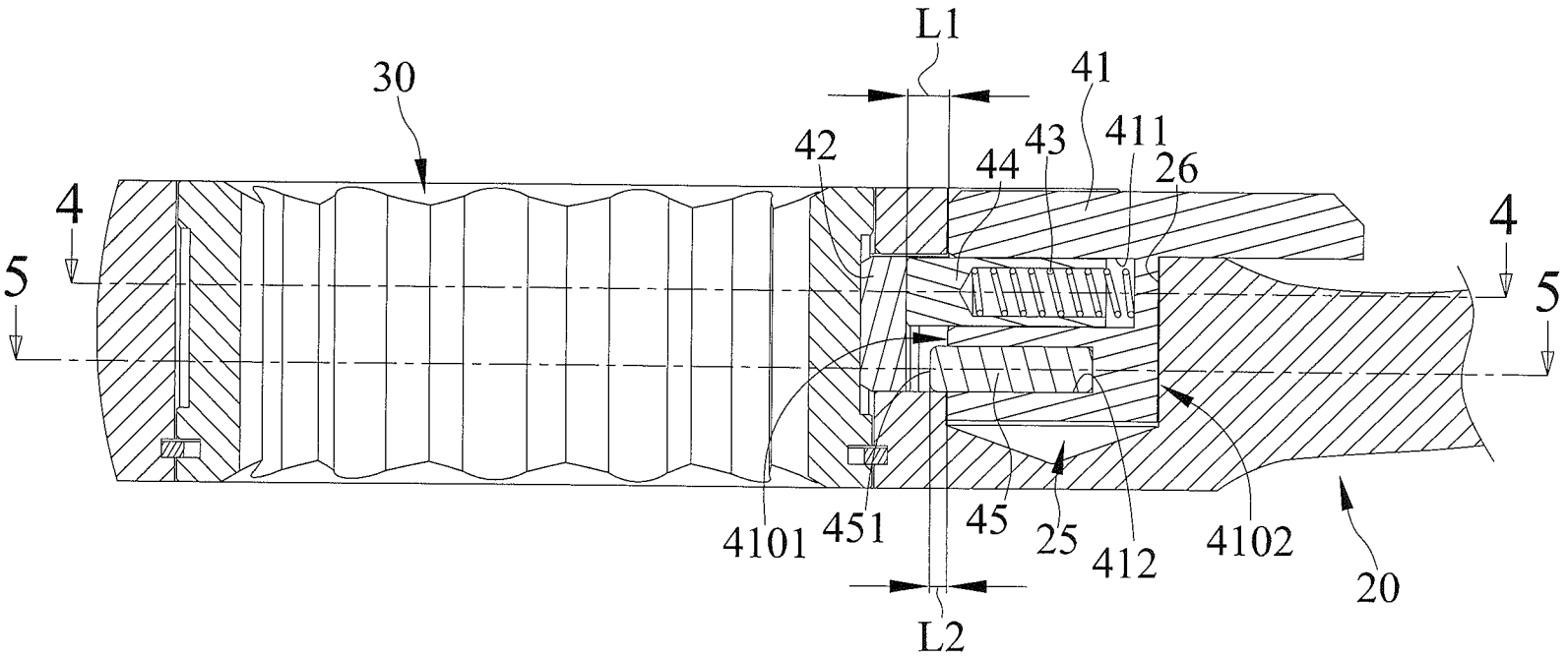
FIG. 3 is a partial, cross sectional view of the reversible ratchet wrench of FIG. 1.

FIGS. 1-3 show a reversible ratchet wrench 10 of a first embodiment according to the present invention. Reversible ratchet wrench 10 includes a body 20, a driving member 30, and a ratcheting device 40.

Body 20 includes an operative portion 21 and a driving end 22 connected to handle 21. Operative portion 21 is adapted to be gripped by a user. Driving end 22 includes first and second sides spaced from each other in a thickness direction. Driving end 22 further includes a receiving space 23 extending from the first side through the second side. Driving end 22 further includes a compartment 24 located between the first and second sides of body 20 and intercommunicated with the receiving space 23. Compartment 24 extends towards operative portion 21 in a length direction perpendicular to the thickness direction. Body 20 further includes a hole 25 extending from the first side towards but spaced from the second side of body 20. Hole 25 intercommunicates compartment 24 with the outside. Hole 25 includes an abutment wall 26 facing compartment 24. Abutment wall 26 is arcuate in this embodiment. Body 20 further includes two limiting portions 27 between compartment 24 and hole 25. Limiting portions 27 are spaced from each other in a width direction perpendicular to the length and thickness directions.

Driving member 30 is mounted in receiving space 23 of body 20. Driving member 30 is rotatable about a rotational axis C relative to driving end 22 of body 20. Rotational axis C is parallel to the thickness direction in this embodiment. Driving member 30 includes a driving portion 31 adapted for directly or indirectly driving a fastener. Driving portion 31 surrounds rotational axis C. In the form shown in FIGS. 1-12, driving portion 31 includes an inner periphery having a plurality of protrusions and recessed portions. Other forms of driving portion 31 can be used. Driving member 30 further includes an annular toothed portion 32 on an outer periphery thereof.

Ratcheting device 40 includes a switch button 41, a pawl 42, an elastic element 43, a pressing member 44, and a protrusion provided on switch button 41. Switch button 41 is received in hole 25 of body 20. Switch button 41 is pivotable relative to body 20 about a pivotal axis S parallel to rotational axis C and perpendicular to the width direction. Switch button 41 includes a first side 4101 facing compartment 24 and a second side 4102 opposite to first side 4101. First side 4010 of switch button 41 is intermediate pawl 42 and second side 4102 of switch button 41. Switch button 41 further includes a pressing member receptacle 411 extending from first side 4101 towards second side 4102. In this embodiment, pressing member receptacle 411 extends from first side 4101 towards but spaced from second side 4102. Second side 4102 of switch button 41*a* pivotably abuts abutment wall 26.

In this embodiment, switch button 41 further includes a fixing member receptacle 412 extending from first side 4101 towards but spaced from second side 4102 of switch button 41. Pressing member receptacle 411 and fixing member receptacle 412 extend perpendicularly to pivotal axis S, are parallel to each other, and are spaced from each other along pivotal axis S.

Pawl 42 is slideably received in compartment 24 of body 20 and is located between driving member 30 and switch button 41. Pawl 42 includes a first side having a toothed portion 421 disengageably engaged with annular toothed portion 32 of driving member 30. Pawl 42 further includes a second side. In this embodiment, the second side of pawl 42 includes a recessed portion 422.

Elastic element 43 is received in pressing member receptacle 411. Pressing member 44 is also received in pressing member receptacle 411 and is biased by elastic element 43. Pressing member 44 has a first end located outside of pressing member receptacle 411 and a second end received in pressing member receptacle 411. An end of elastic element 43 abuts an end wall of pressing member receptacle 411. The other end of elastic element 43 abuts the second end of pressing member 44. In this embodiment, pressing member 44 includes a receptacle having an end wall against which the other end of elastic element 43 abuts. The first end of pressing member 44 is biased by elastic element 43 into recessed portion 422 of pawl 42 to thereby press against the second side of pawl 42, causing engagement between toothed portion 421 of pawl 42 and annular toothed portion 32 of driving member 30. The first end of pressing member 44 has a first spacing L1 to first side 4101 of switch button 41. Pressing member 44 is slideable in pressing member receptacle 411 in a radial direction perpendicular to pivotal axis S, preventing switch button 41 from disengaging from hole 25 along pivotal axis S. Furthermore, pivotal movement of switch button 41 about pivotal axis S is stopped when pressing member 44 contacts and is stopped by one of limiting portions 27.

A fixing member 45 is received in fixing member receptacle 412 and has a first end exposed outside of fixing member receptacle 412. The first end of fixing member 45 forms the protrusion on first side 4101 of switch button 41. Fixing member 45 further includes a second end abutting an end wall of fixing member receptacle 412. The protrusion includes a contact portion 451 having a second spacing L2 to first side 4101 of switch button 41. Contact portion 451 is normally spaced from pawl 42 but can press against recessed portion 422 of pawl 42 if pawl 42 malfunctions. Both of fixing member 45 and switch button 41 have a hardness larger than a hardness of pawl 42. In this embodiment, fixing member 45 is solid and has circular cross sections.

Switch button 41 can be operated to pivot relative to body 20 to change a driving direction and a non-driving direction of body 20. Specifically, when body 20 rotates in the driving direction, a fastener coupled with driving portion 31 of driving member 30 rotate jointly with body 20 in the driving direction. On the other hand, when body 20 rotates in the non-driving direction, the fastener and driving member 30 do not rotate and remain still. Operation of switch button 41 and body 20 can be appreciated by a person having ordinary skill in the art.

Figure 6:
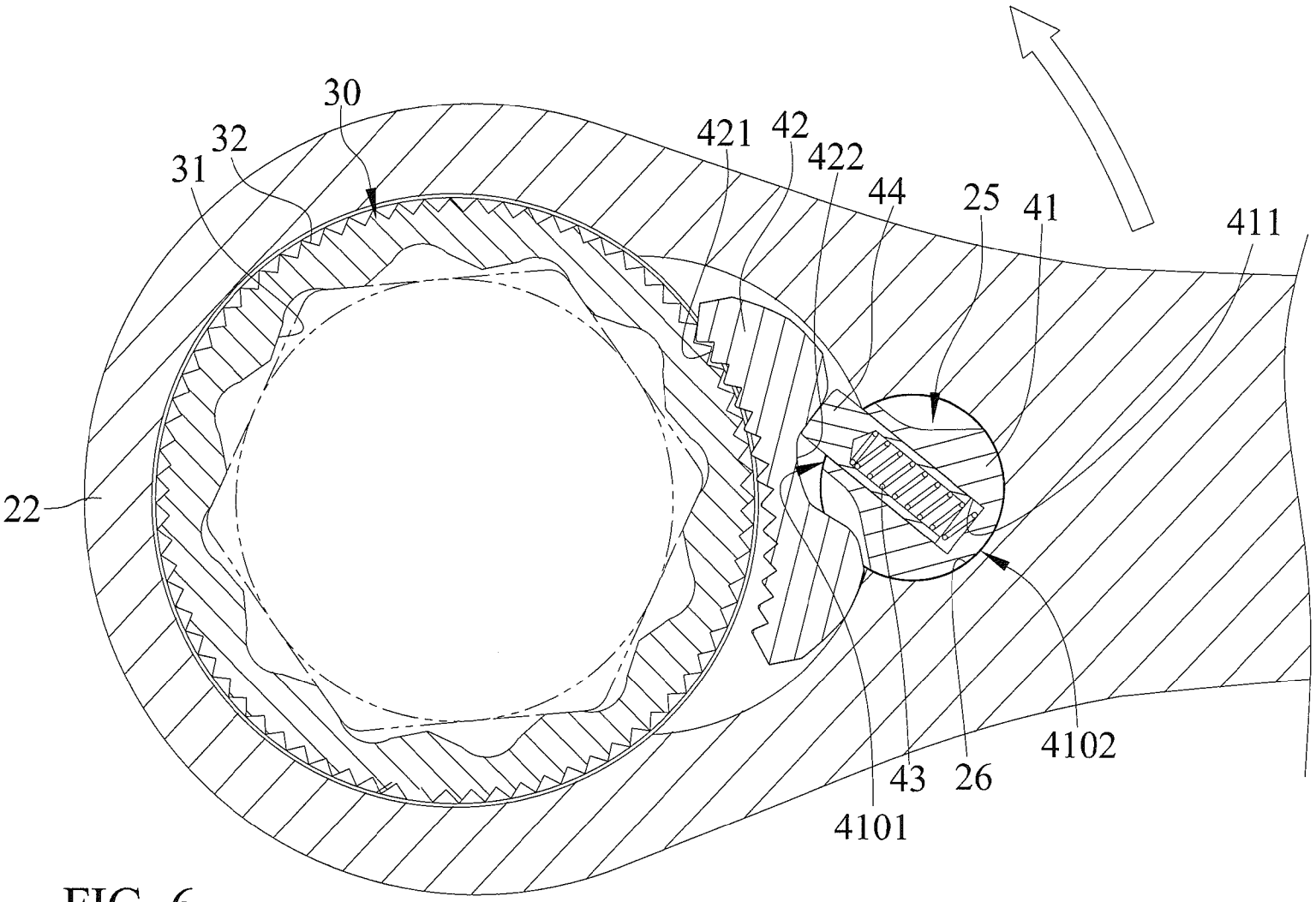
FIG. 6 is a view similar to FIG. 4, illustrating disengagement of a pawl from a driving member during normal operation of the reversible ratchet wrench of FIG. 1.
Figure 7:
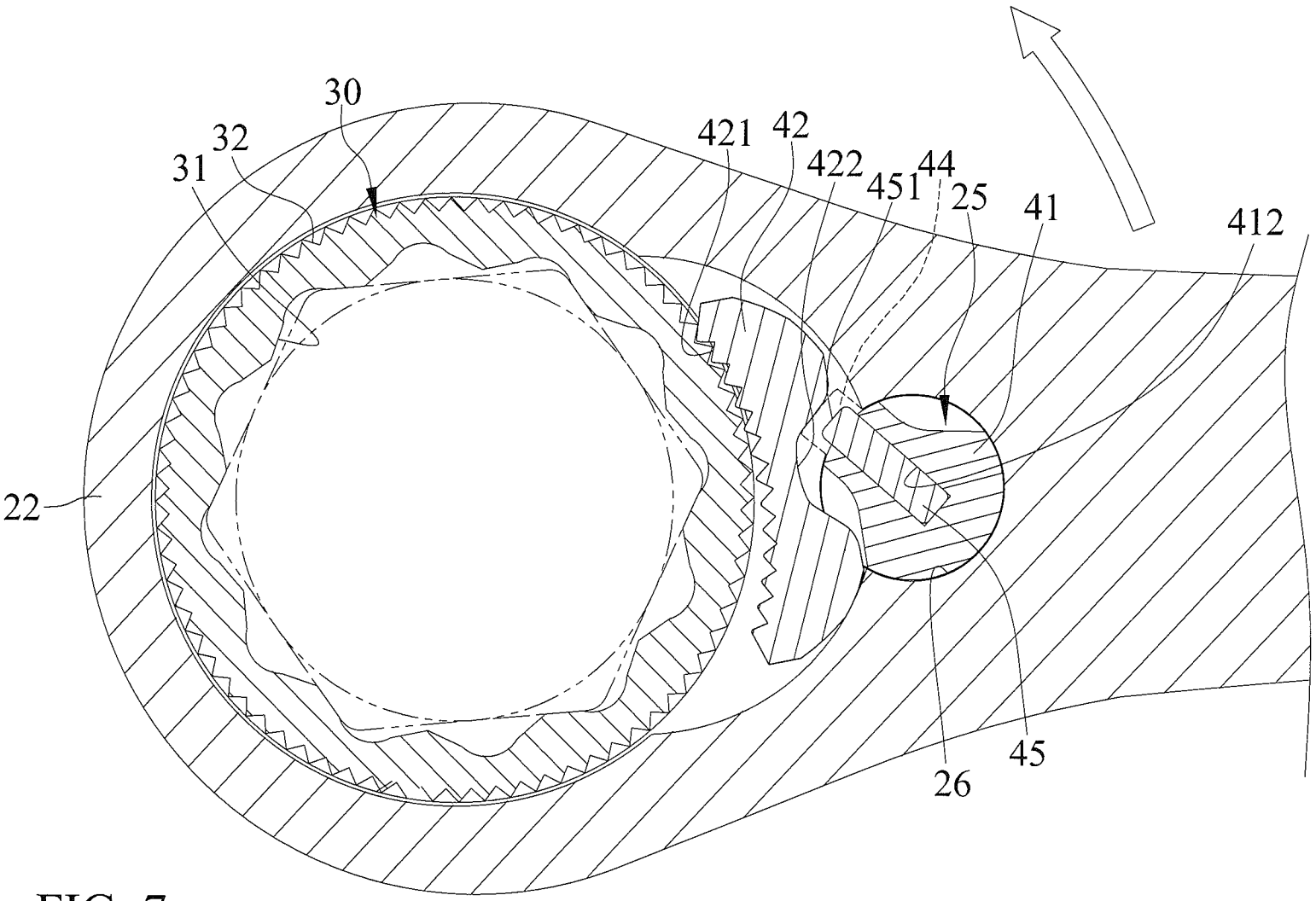
FIG. 7 is a view similar to FIG. 5, illustrating disengagement of the pawl from the driving member during normal operation of the reversible ratchet wrench of FIG. 1.

With reference to FIGS. 6 and 7, during normal operation, pawl 42 slides in compartment 24 and is pressed by pressing member 44 to disengage from annular toothed portion 32 of driving member 30 while body 20 rotates in the non-driving direction, and first spacing L1 of pressing member 44 is not smaller than second spacing L2 of the protrusion. Specifically, when body 20 rotates in the non-driving direction, pawl 42 cannot drive driving member 30 to rotate. Rather, driving member 30 pushes pawl 42 away from driving member 30. Thus, pawl 42 disengages from driving member 30, pushes pressing member 44 away from driving member 30, and compresses elastic element 43. The protrusion formed by fixing member 45 does not contact pawl 42.

Figure 8:
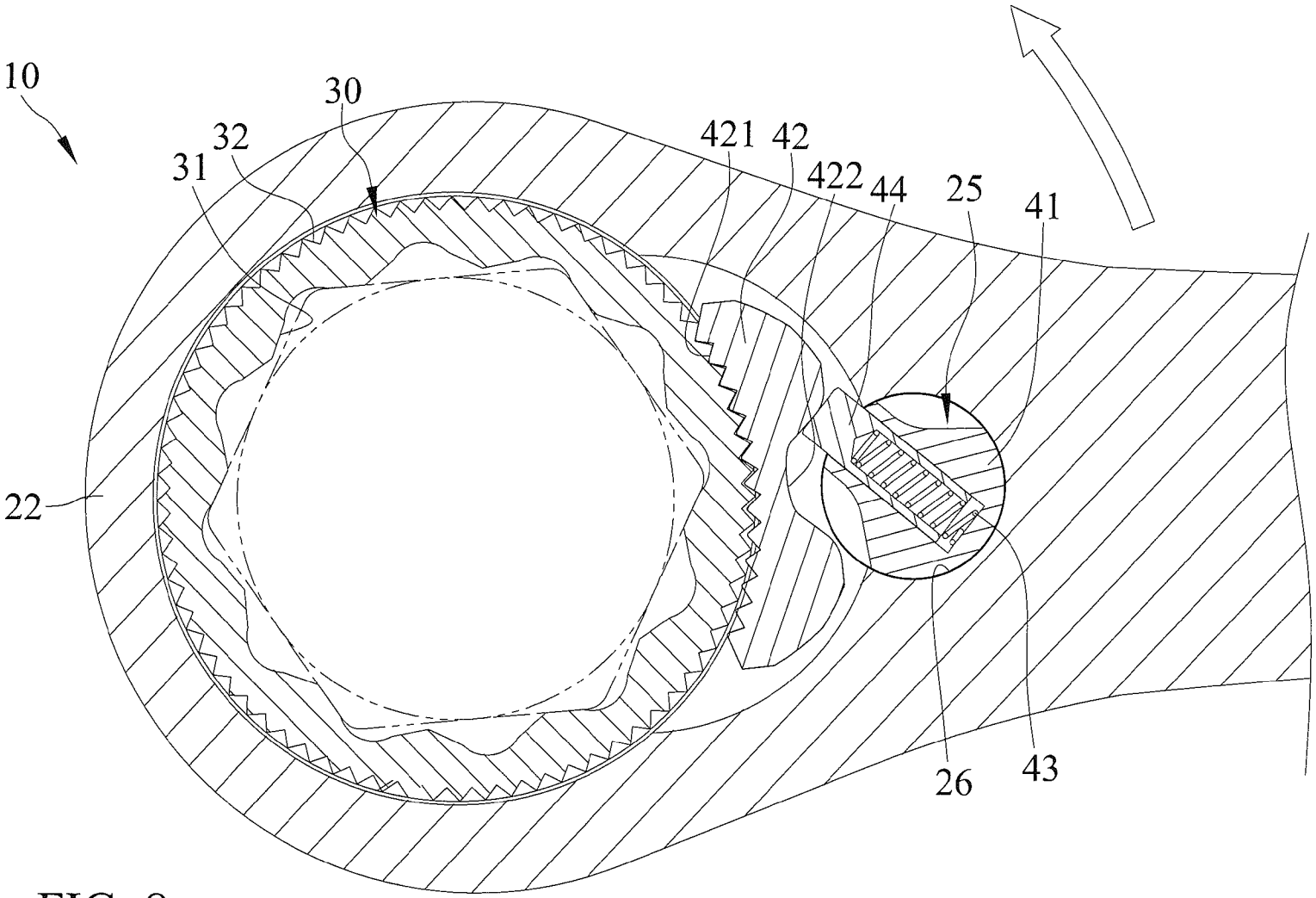
FIG. 8 is a view similar to FIG. 6, illustrating engagement between the pawl and the driving member of the reversible ratchet wrench of FIG. 1 in a case of oil between the pawl and the driving member.
Figure 9:
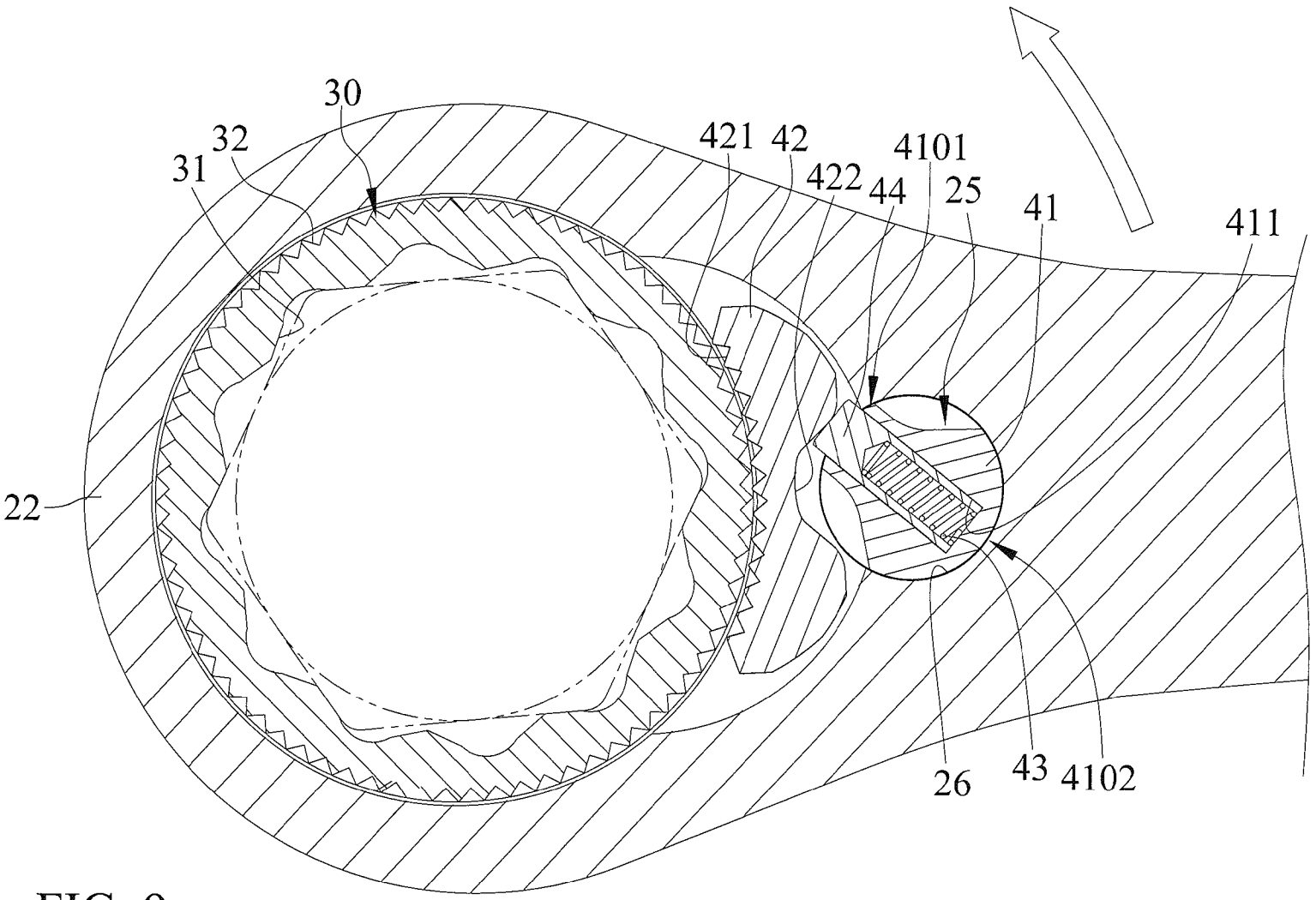
FIG. 9 is a view similar to FIG. 8, illustrating operation of the reversible ratchet wrench of FIG. 1 in a case of oil between the pawl and the driving member, with a pressing member pressing against the pawl.
Figure 10:
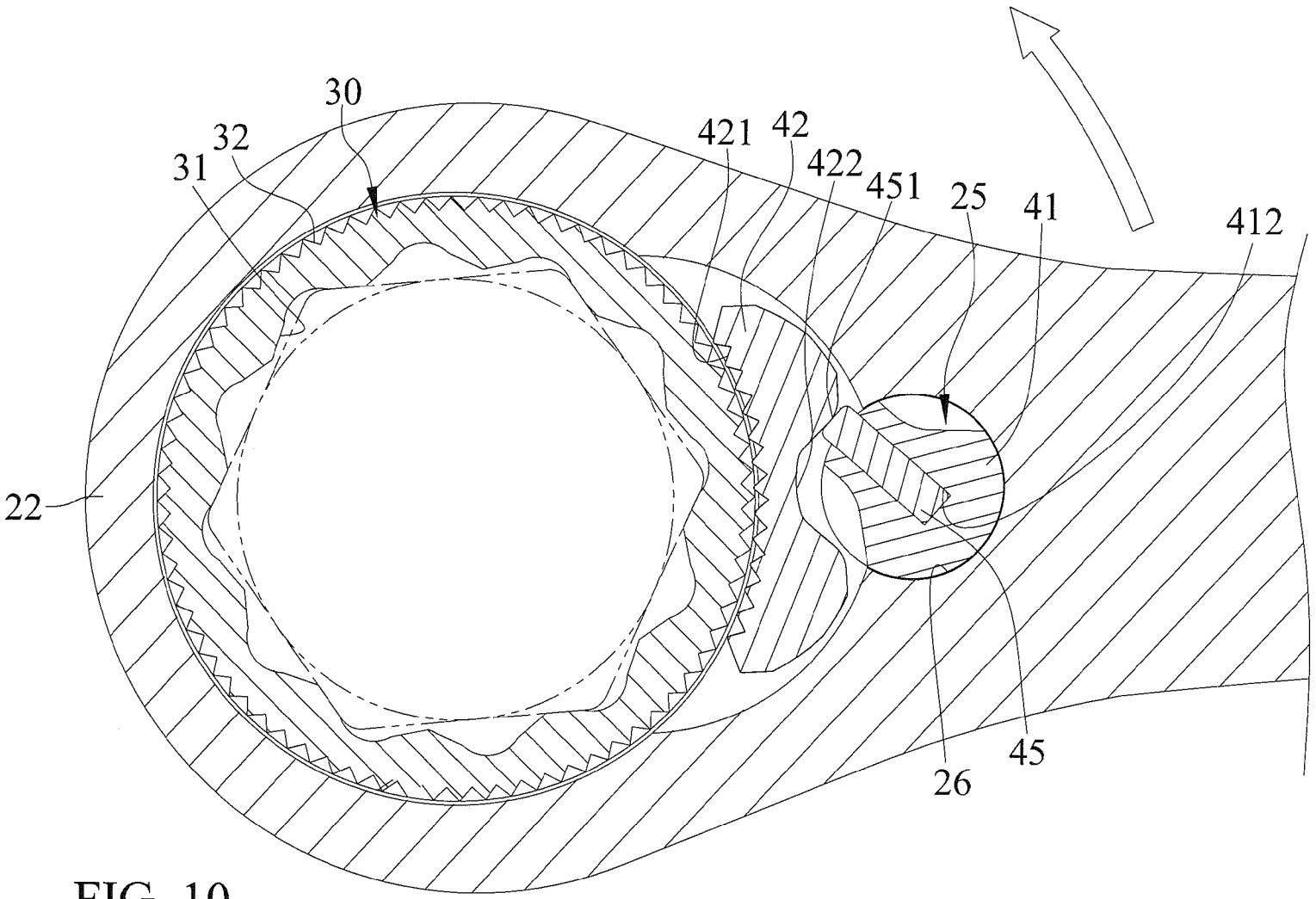
FIG. 10 is a view similar to FIG. 5, illustrating operation of the reversible ratchet wrench of FIG. 1 in a case of oil between the pawl and the driving member, with a fixing member pressing against the pawl to disengage the pawl from the driving member.

With reference to FIGS. 8-10, in a case that oil or direct enters body 20 and accumulates between pawl 42 and driving member 30, toothed portion 421 of pawl 42 cannot smoothly engage with or disengage from annular toothed portion 32 of driving member 30. Namely, pawl 42 gets stuck on driving member 30. With reference to FIG. 8, when body 20 is rotated in the non-driving direction, pawl 42 moves away from driving member 30. With reference to FIGS. 9 and 10, when elastic element 43 is compressed to an extent in which first spacing L1 of pressing member 44 is not larger than second spacing L2 of the protrusion, contact portion 451 of the protrusion presses against recessed portion 422 of pawl 42 to forcibly disengage toothed portion 421 of pawl 42 from annular toothed portion 32 of driving member 30. This avoids excessive compression of pressing member 44 by pawl 42 while the user still continuously rotates reversible ratchet wrench 10. Thus, deformation of pressing member 44 resulting from excessive pressure is avoided, preventing reversible ratchet wrench 10 from malfunctioning and damage.

Likewise, if toothed portion 421 of pawl 42 cannot smoothly engage with or disengage from annular toothed portion 32 of driving member 30 due to rusting of pawl 42 and/or driving member 30, contact portion 451 of the protrusion can press against recessed portion 422 of pawl 42 to forcibly disengage pawl 42 from driving member 30, avoiding reversible ratchet wrench 10 from malfunctioning and damage. Furthermore, this provision also assures sliding movement of pressing member 44 in pressing member receptacle 411 while preventing switch button 41 from disengaging from hole 25.

Figure 4:
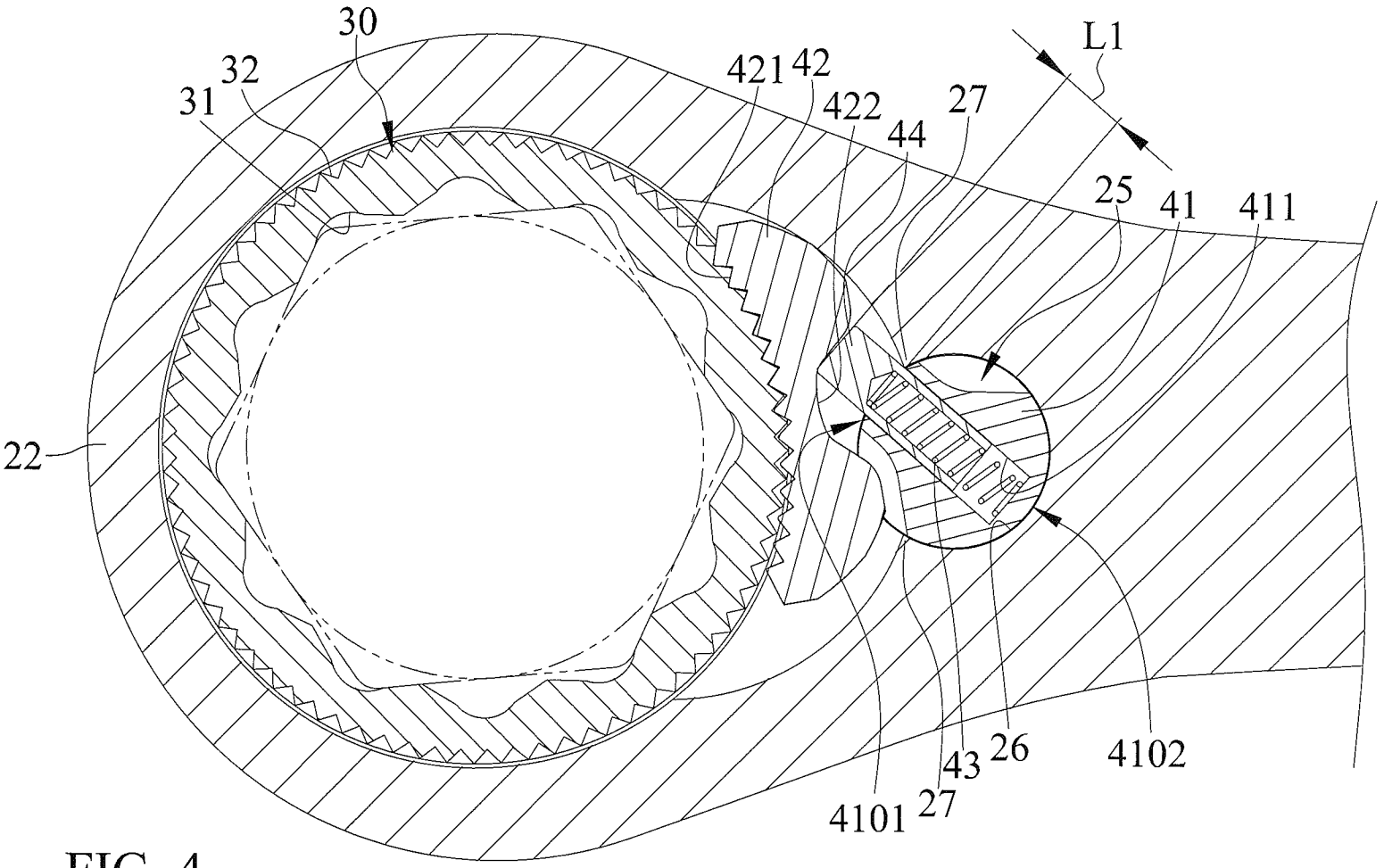
FIG. 4 is a cross sectional view taken along section line 4-4 of FIG. 3.
Figure 5:
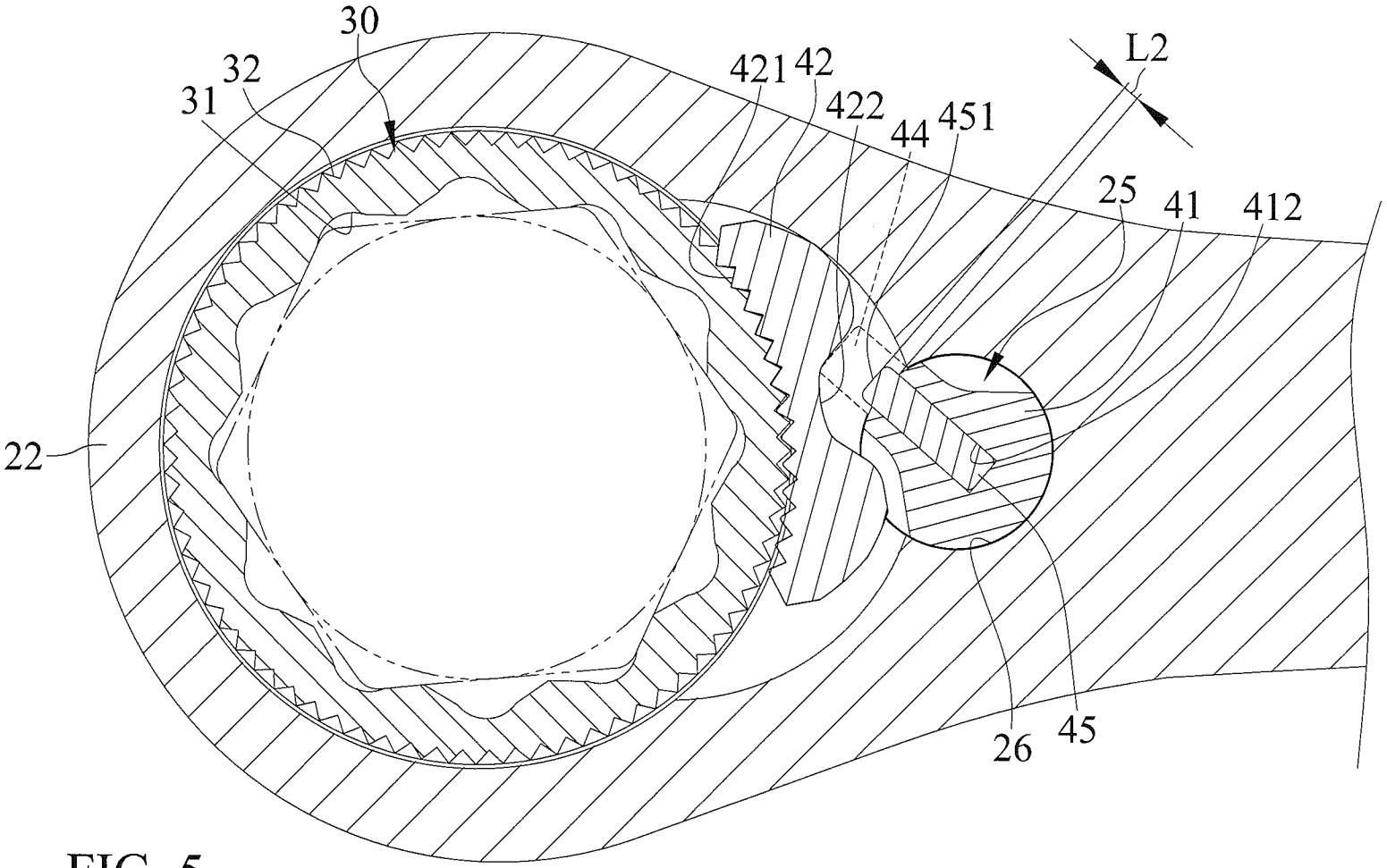
FIG. 5 is a cross sectional view taken along section ling 5-5 of FIG. 3.

After contact portion 451 of the protrusion impinges recessed portion 422 of pawl 42, toothed portion 421 of pawl 42 is forcibly disengaged from annular toothed portion 32 of driving member 30, such that reversible ratchet wrench 10 returns to the normal state shown in FIGS. 4 and 5. Pressing member 44 is biased by elastic element 43 to press against pawl 42 such that pawl 42 reengages with driving member 30, effectively avoiding deformation of pressing member 44 resulting from non-smooth engagement or disengagement between pawl 42 and driving member 30 while preventing switch button 41 from disengaging from hole 25, prolonging the service life of reversible ratchet wrench 10.

Figure 11:
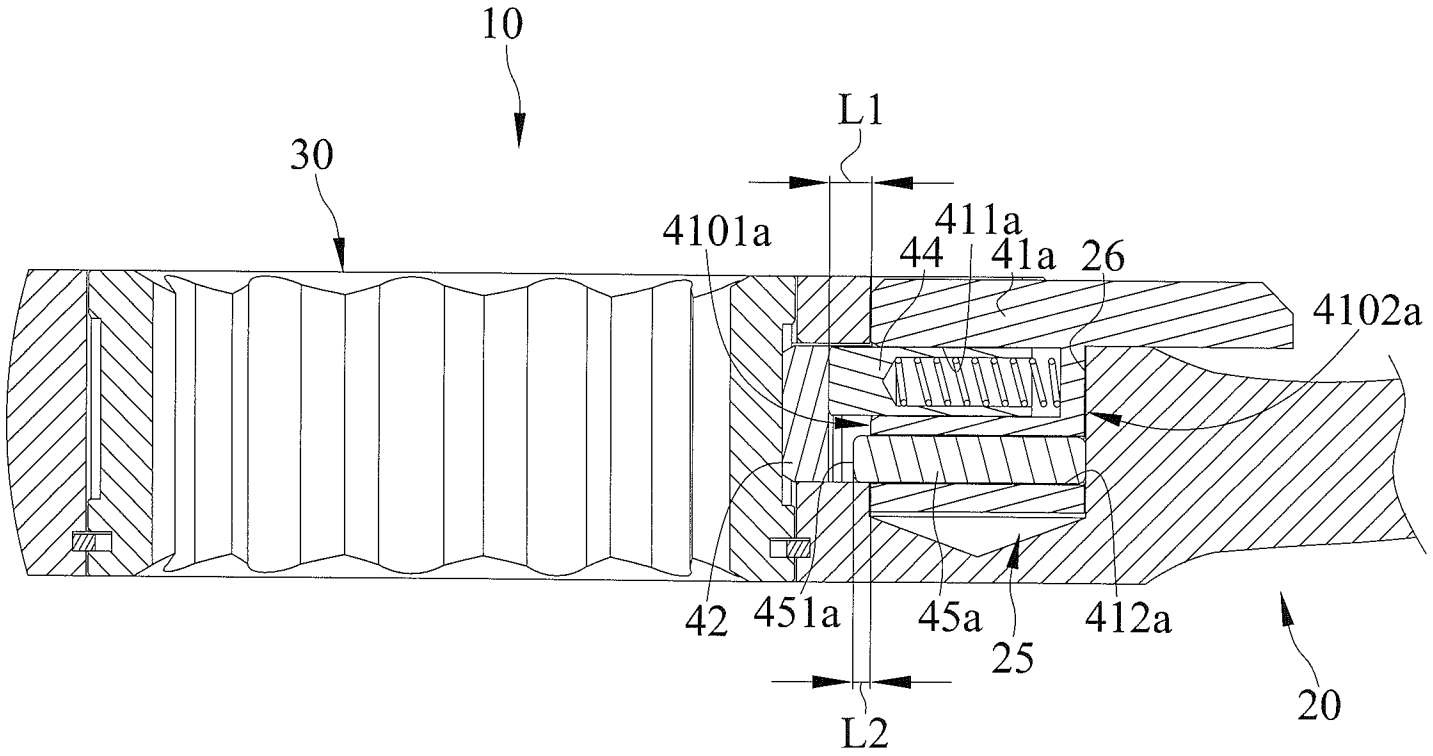
FIG. 11 is a partial, cross sectional view of a reversible ratchet wrench of a second embodiment according to the present invention.

FIG. 11 shows a reversible ratchet wrench 10 of a second embodiment according to the present invention. The second embodiment is substantially the same as the first embodiment. Specifically, fixing member receptacle 412*a* of the second embodiment extends from first side 4101*a* through second side 4102*a* of switch button 41*a*. Second side 4102*a* of switch button 41*a* and the second end of fixing member 45*a* pivotably abut abutment wall 26 of body 20. The first end of pressing member 44 has a first spacing L1 to first side 4101*a* of switch button 41*a*. The first end of fixing member 45*a* forms the protrusion on first side 4101*a* of switch button 41*a*. The protrusion includes a contact portion 451*a* having a second spacing L2 to first side 4101*a* of switch button 41*a*. Contact portion 451*a* is normally spaced from pawl 42*a* but can press against recessed portion 422 of pawl 42 if pawl 42 malfunctions. Operation of the second embodiment is similar to the first embodiment. Namely, during normal operation, pawl 42 slides in compartment 24 and is pressed by pressing member 44 to disengage from annular toothed portion 32 of driving member 30 while body 20 rotates in the non-driving direction, and first spacing L1 of pressing member 44 is not smaller than second spacing L2 of the protrusion. Nevertheless, when pawl 42 slides in compartment 24 while body 20 rotates in the non-driving direction, if pawl 30 pressed by pressing member 44 does not disengage from annular toothed portion 32 of driving member 30, contact portion 451*a* of the protrusion presses against pawl 42 to forcibly disengage pawl 42 from annular toothed portion 32 of the driving member 30 when elastic element 43 is compressed to an extent in which first spacing L1 of pressing member 44 is not larger than second spacing L2 of the protrusion.

Since the second end of fixing member 45*a* abuts abutment wall 26, when contact portion 451*a* of fixing member 45*a* presses against pawl 42, switch button 41*a* does not have to withstand the reactive force from fixing member 45*a*. Rather, abutment wall 26 of body 20 withstands the reactive force. Thus, switch button 41*a* can be made of a material having a lower hardness (but still larger than the hardness of pawl 42), reducing the overall manufacturing costs of reversible ratchet wrench 10.

Figure 12:
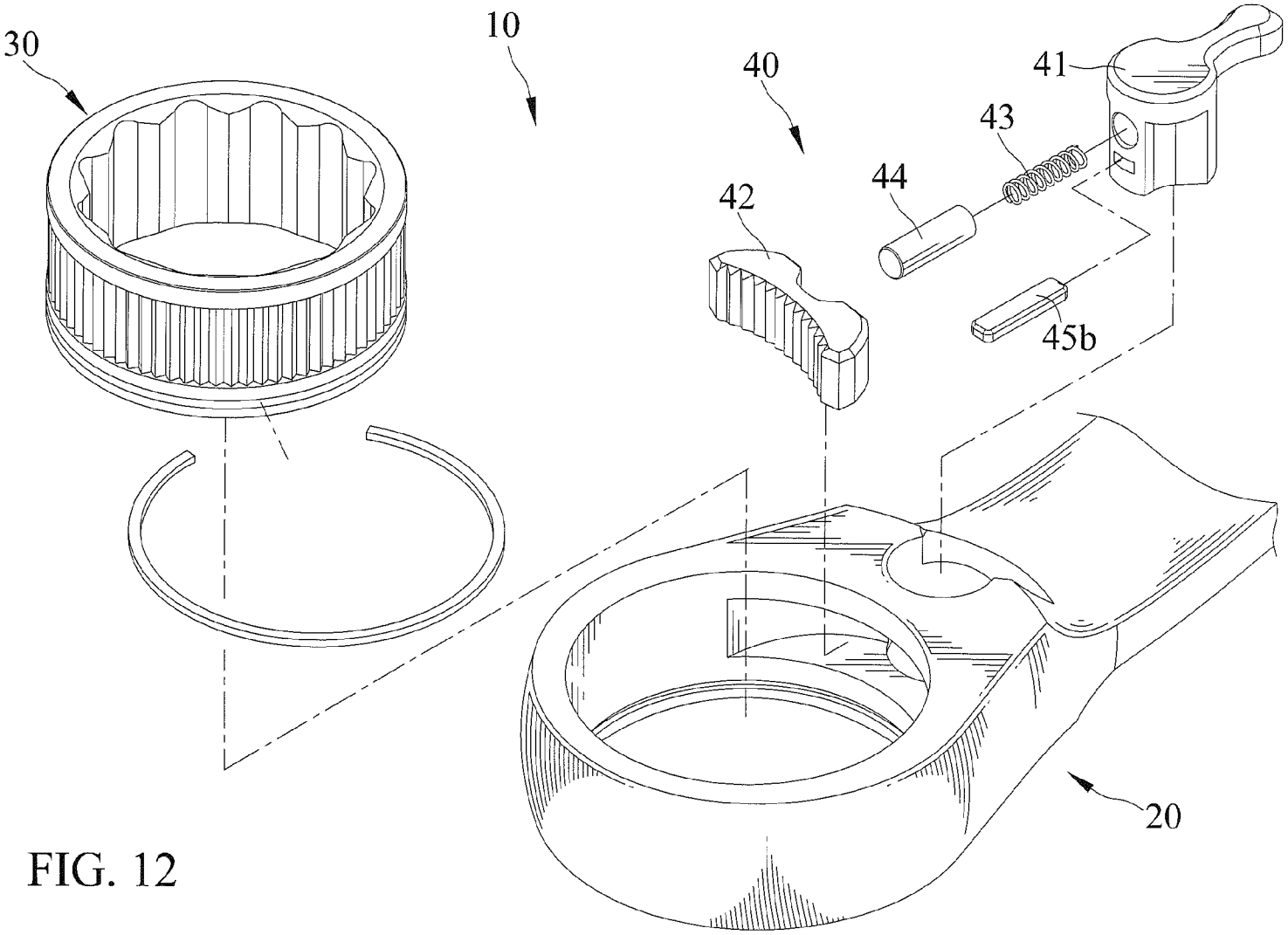
FIG. 12 is a partial, exploded, perspective view of a reversible ratchet wrench of a third embodiment according to the present invention.

FIG. 12 shows a reversible ratchet wrench of a third embodiment according to the present invention. The third embodiment is substantially the same as the first embodiment except that fixing member 45*b* is solid and has rectangular cross sections.

In view of the foregoing, when pawl 42 and driving member 30 malfunctions, contact portion 451, 451*a* of the protrusion presses against recessed portion 422 of pawl 42 to forcibly disengage toothed portion 421 of pawl 42 from annular toothed portion 32 of driving member 30. This avoids excessive compression of pressing member 44 by pawl 42 while the user still continuously rotates reversible ratchet wrench 10. Thus, deformation of pressing member 44 resulting from excessive pressure is avoided, preventing reversible ratchet wrench 10 from malfunctioning and damage.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A reversible ratchet wrench comprising:

a body including an operative portion and a driving end connected to the operative, with the operative portion adapted to be gripped by a user, with the driving end including a receiving space and a compartment intercommunicated with the receiving space, with the body further including a hole intercommunicating the compartment with an outside;

a driving member mounted in the receiving space, with the driving member rotatable about a rotational axis relative to the driving end of the body, with the driving member including a driving portion adapted for directly or indirectly driving a fastener, with the driving member further including an annular toothed portion on an outer periphery thereof;

a pawl slideably received in the compartment, with the pawl including a first side having a toothed portion disengageably engaged with the annular toothed portion of the driving member, with the pawl further including a second side;

a switch button received in the hole of the body, with the switch button pivotable relative to the body about a pivotal axis parallel to the rotational axis, with the switch button including a first side facing the compartment and a second side opposite to the first side, with the switch button further including a pressing member receptacle extending from the first side towards the second side;

an elastic element received in the pressing member receptacle; and a pressing member received in the pressing member receptacle and having a first end located outside of the pressing member receptacle, with the first end of the pressing member having a first spacing to the first side of the switch button, with the first end of the pressing member biased by the elastic element to press against the second side of the pawl, causing engagement between the toothed portion of the pawl and the annular toothed portion of the driving member; and a protrusion provided on the first side of the switch button and including a contact portion having a second spacing to the first side of the switch button, wherein the switch button is operable to pivot relative to the body to change a driving direction and a non-driving direction of the body, wherein the driving member and the fastener coupled to the driving member adapted to rotate jointly with the body while the body rotates in the driving direction, and wherein the driving member and the fastener coupled to the driving member adapted to remain still when the body rotates in the non-driving direction, wherein the pawl slides in the compartment and is pressed by the pressing member to disengage from the annular toothed portion of the driving member while the body rotates in the non-driving direction, and the first spacing of the pressing member is not smaller than the second spacing of the protrusion, and wherein if the pawl slides in the compartment while the body rotates in the non-driving direction and if the pawl pressed by the pressing member does not disengage from the annular toothed portion of the driving member, the contact portion of the protrusion presses against the pawl to disengage the pawl from the annular toothed portion of the driving member when the elastic element is compressed to an extent in which the first spacing of the pressing member is not larger than the second spacing.

2. The reversible ratchet wrench as claimed in claim 1, with the switch button further including a fixing member receptacle extending from the first side towards the second side of the switch button, with a fixing member received in the fixing member receptacle and having a first end exposed outside of the fixing member receptacle, and with the first end of the fixing member forming the protrusion.

3. The reversible ratchet wrench as claimed in claim 2, with the fixing member receptacle extending from the first side towards but spaced from the second side of the switch button, and with the fixing member further including a second end abutting an end wall of the fixing member receptacle.

4. The reversible ratchet wrench as claimed in claim 3, wherein each of the fixing member and the switch button has a hardness larger than a hardness of the pawl.

5. The reversible ratchet wrench as claimed in claim 3, with the body including two limiting portions between the compartment and the hole, and with the two limiting portions spaced from each other in a width direction perpendicular to the pivotal axis, wherein pivotal movement of the switch button about the pivotal axis is stopped when the pressing member contacts and is stopped by one of the two limiting portions.

6. The reversible ratchet wrench as claimed in claim 2, with the hole of the body including an abutment wall, with the second side of the switch button pivotably abutting the abutment wall, with the fixing member receptacle extending from the first side through the second side of the switch button, and with the fixing member further including a second end pivotably abutting the abutment wall.

7. The reversible ratchet wrench as claimed in claim 6, wherein the fixing member has a hardness larger than a hardness of the pawl.

8. The reversible ratchet wrench as claimed in claim 2, wherein the fixing member is solid and has circular cross sections.

9. The reversible ratchet wrench as claimed in claim 2, wherein the fixing member is solid and has rectangular cross sections.

10. The reversible ratchet wrench as claimed in claim 2, wherein the pressing member receptacle and the fixing member receptacle extend perpendicularly to the pivotal axis, are parallel to each other, and are spaced from each other along the pivotal axis.

11. The reversible ratchet wrench as claimed in claim 1, with the pressing member receptacle extending from the first side towards but spaced from the second side of the switch button, with the elastic element further having a second end abutting an end wall of the pressing member receptacle, with the second side of the pawl including a recessed portion, and with the first end of the pressing member pressing against the recessed portion.

* * * * *